US006755421B1

(12) United States Patent
Aftergood

(10) Patent No.: US 6,755,421 B1
(45) Date of Patent: Jun. 29, 2004

(54) METHOD OF PLAYING A VARIATION OF SEVEN CARD STUD POKER

(75) Inventor: Ron Benjamin Aftergood, Calgary (CA)

(73) Assignee: Tortugas Trading Company Ltd., Calgary (CA)

( * ) Notice: Subject to any disclaimer, the term of this patent is extended or adjusted under 35 U.S.C. 154(b) by 0 days.

(21) Appl. No.: 10/454,927

(22) Filed: Jun. 4, 2003

(51) Int. Cl.[7] ..... A63F 1/00

(52) U.S. Cl. ..... 273/292; 273/274; 273/309; 463/13; 463/26

(58) Field of Search ..... 273/292, 274, 273/309; 463/13, 26, 27, 28

(56) References Cited

U.S. PATENT DOCUMENTS 5,332,228 A * 7/1994 Schultz ..... 463/13
5,356,140 A * 10/1994 Dabrowski et al. ..... 463/12
5,531,440 A * 7/1996 Dabrowski et al. ..... 463/12
5,531,441 A * 7/1996 Dabrowski et al. ..... 463/12
5,816,914 A * 10/1998 Wichinsky ..... 463/13
5,839,731 A * 11/1998 Feola ..... 273/292
5,851,011 A * 12/1998 Lott ..... 273/292
5,951,012 A * 9/1999 Feola ..... 273/292
5,984,309 A * 11/1999 Santin ..... 273/292
6,048,267 A * 4/2000 Wichinsky ..... 463/13
6,129,357 A * 10/2000 Wichinsky ..... 273/292
6,131,907 A * 10/2000 Nucifora et al. ..... 273/292
6,206,373 B1 * 3/2001 Garrod ..... 273/292
6,270,405 B1 * 8/2001 Ferguson ..... 463/13
6,299,170 B1 * 10/2001 Yoseloff ..... 273/292
6,334,613 B1 * 1/2002 Yoseloff ..... 273/292
6,386,973 B1 * 5/2002 Yoseloff ..... 463/13
6,402,147 B1 * 6/2002 Lo ..... 273/292
6,454,266 B1 * 9/2002 Breeding et al. ..... 273/292
6,536,768 B2 3/2003 Caputo ..... 273/292
6,575,465 B2 * 6/2003 Lo ..... 273/292
6,575,467 B1 * 6/2003 Kal ..... 273/292
6,588,757 B1 * 7/2003 Lo ..... 273/292
6,637,747 B1 * 10/2003 Garrod ..... 273/292
6,638,163 B2 * 10/2003 Moody ..... 463/13
6,669,198 B2 * 12/2003 Wichinsky ..... 273/292

* cited by examiner

*Primary Examiner*—Benjamin H. Layno
*Assistant Examiner*—D Collins
(74) *Attorney, Agent, or Firm*—Christensen O'Connor Johnson Kindness PLLC

(57) ABSTRACT

A method of playing a variation of seven card stud poker. A venue is provided at which not less then three players and not more than six players compete for a jackpot against each other and not against a house. Play is commenced using a 54 card deck consisting of 52 regular playing cards and two wild cards. The players ante toward a jackpot and are dealt a first card face up, a second card face down and a third card face down. Each player is allowed to view the faces of the second card and the third card dealt to them. As each subsequent card is received, the players can elect to either fold or place a bet toward the jackpot. After a number of betting rounds, the winner of the jackpot is determined.

4 Claims, 4 Drawing Sheets

12
14
16
18
19
20
22
24
26
28
30
32
34
36
38
40
42
44
46
48
50
52
54
56

METHOD OF PLAYING A VARIATION OF SEVEN CARD STUD POKER

FIELD OF THE INVENTION

The present invention relates to a method of playing a variation of seven card stud poker, called "Nine Ball Combo Poker".

BACKGROUND OF THE INVENTION

"Rake" style of gambling games are becoming increasingly popular in casinos. In "rake" style gambling games, the casino assumes no risk and no money is wagered against the "house". The casino merely provides a venue and game amenities (dealer, table, chips, etc) and, in return, receives a portion of the pot for every game played. Persons will not participate in "rake" style of gambling games they are unfamiliar with, unless the rules are easy to understand. There must also be ample opportunity for wagering during the course of the game.

SUMMARY OF THE INVENTION

What is required is a method of playing a variation of seven card stud poker, which is suited for "rake" style of gambling.

According to the present invention there is provided a method of playing a variation of seven card stud poker. A first step involves providing a venue at which not less then three players and not more than six players compete for a jackpot against each other and not against a house. The jackpot for each game may be won by the player with the highest hand ("hi") or the player with the lowest hand ("lo") or it may be won and split by two players: the player with the highest hand and the player with the lowest hand ("hi/lo"). By rotation, in turn before each game, one player is given the right to choose how the jackpot will be won. Before play commences for each game, the designated player accepts a three-sided 'chip' which he rotates to indicate his "dealers choice": hi, lo, or hi/lo. Play is commenced with a 54 card deck consisting of 52 regular playing cards and two wild cards. An ante is placed toward a jackpot before a player is entitled to receive any cards. A second step involves dealing a first card face up, a second card face down and a third card face down to each player and allowing each individual player to view the faces of the second card and the third card dealt to them. Each player can elect to either fold, in which case the ante is lost and the player is out of the game, or place a first bet of a predetermined amount toward the jackpot. A third step involves dealing a fourth card face up to each remaining player. Each player can elect to either fold, in which case the first bet and the ante are lost and the player is out of the game, or place a second bet of a predetermined amount toward the jackpot. A fourth step involves dealing a fifth card face up to each remaining player. Each player can elect to either fold, in which case the first bet, the second bet and the ante are lost and the player is out of the game, or place a third bet of a predetermined amount toward the jackpot. A fifth step involves dealing a sixth card face up to each remaining player. Each player can elect to either fold, in which case the first bet, the second bet, the third bet and the ante are lost and the player is out of the game, or place a fourth bet of a predetermined amount toward the jackpot. A sixth step involves dealing a seventh card face down to each remaining player and allowing each individual player to view the face of the seventh card dealt to them. Each player can elect to either fold, in which case the first bet, the second bet, the third bet, the fourth bet and the ante are lost and the player is out of the game, or place a fifth bet of a predetermined amount toward the jackpot. A seventh step involves offering each remaining player an option of discarding one card in exchange for an eighth card. The eighth card is dealt either up or down depending upon whether the card it is replacing was face up or face down. Should the eighth card be dealt down, each individual player is allowed to view the face of the eighth card dealt to them. An eighth step involves electing to either fold, in which case the first bet, the second bet, the third bet, the fourth bet, the fifth bet and the ante are lost and the player is out of the game, or place a sixth bet of a predetermined amount toward the jackpot. A ninth step involves offering each remaining player an option of discarding one card in exchange for a ninth card. The ninth card is dealt either up or down depending upon whether the card it is replacing was face up or face down. Should the ninth card be dealt down each individual player is allowed to view the face of the ninth card dealt to them. A tenth step involves electing to either fold, in which case the first bet, the second bet, the third bet, the fourth bet, the fifth bet, the sixth bet and the ante are lost and the player is out of the game, or place a seventh bet of a predetermined amount toward the jackpot. An eleventh step involves determining the winner of the jackpot based upon the determination made at the commencement of play. The winner could be the player with the highest hand, the player with the lowest hand, or the jackpot could be split between the player with the highest hand and the player with the lowest hand.

The poker variant described above is well suited for "rake" gambling games. There are seven betting rounds, which provides ample opportunity to either bet or fold to minimize ones losses. The rules are easy to understand, for after the first round you are betting as you receive or have the option of receiving additional cards. Only a single deck of cards is used, so that the player is aware of what cards are available and can assess the relative strength or weakness of his or her cards. The two wild cards provide an additional dimension to the game. There are a maximum of six players, for if all players remain in the game to the end, all 54 cards will be given out and the deck will be exhausted. Each player is given an option of trading one of the cards for an eighth card or a ninth card. The determination as to how the jackpot is split is made prior to the game commencing. The jackpot can go to the player with the highest hand, the player with the lowest hand, or be split between the player with the highest hand and the player with the lowest hand.

Although beneficial results may be obtained through the method of play as described above, even more beneficial results may be obtained where a variant of the "hi/lo" method of determining a jackpot is used. When a player has what is known as a "bicycle" straight flush (ace, two, three, four and five all in the same suit), that player may elect to go "pig": that is, declare both high and low hands. In this case, the player must win both ends of the game. The low game is a guaranteed win unless another player has another "bicycle" straight flush, in which case there is a tie and the player declaring pig loses. On the high side, the player declaring pig must further weigh his chances in that any higher hand (five of a kind, a higher straight flush etc . . . ) will defeat him, and he will also loose the jackpot. In either scenario where the player who declares pig loses, play reverts to standard hi/lo play.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

The preferred method of playing a variation of seven card stud poker will now be described with reference to FIGS. 1 through 4.

Figure 1:
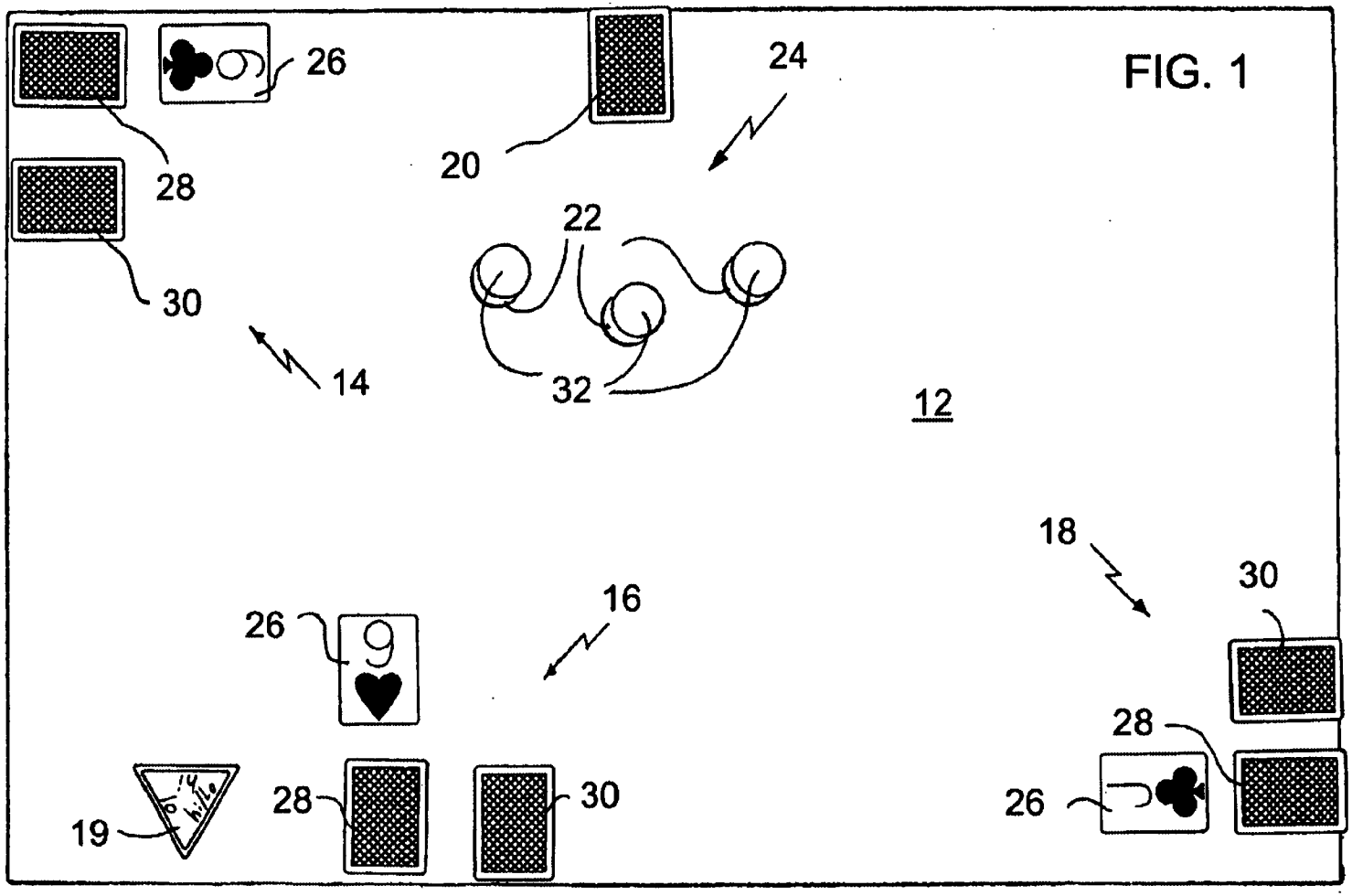
FIG. 1 is a top view of a venue for playing a variation of seven card stud poker and game at the second step: ante, third card and first bet.
Figure 2:
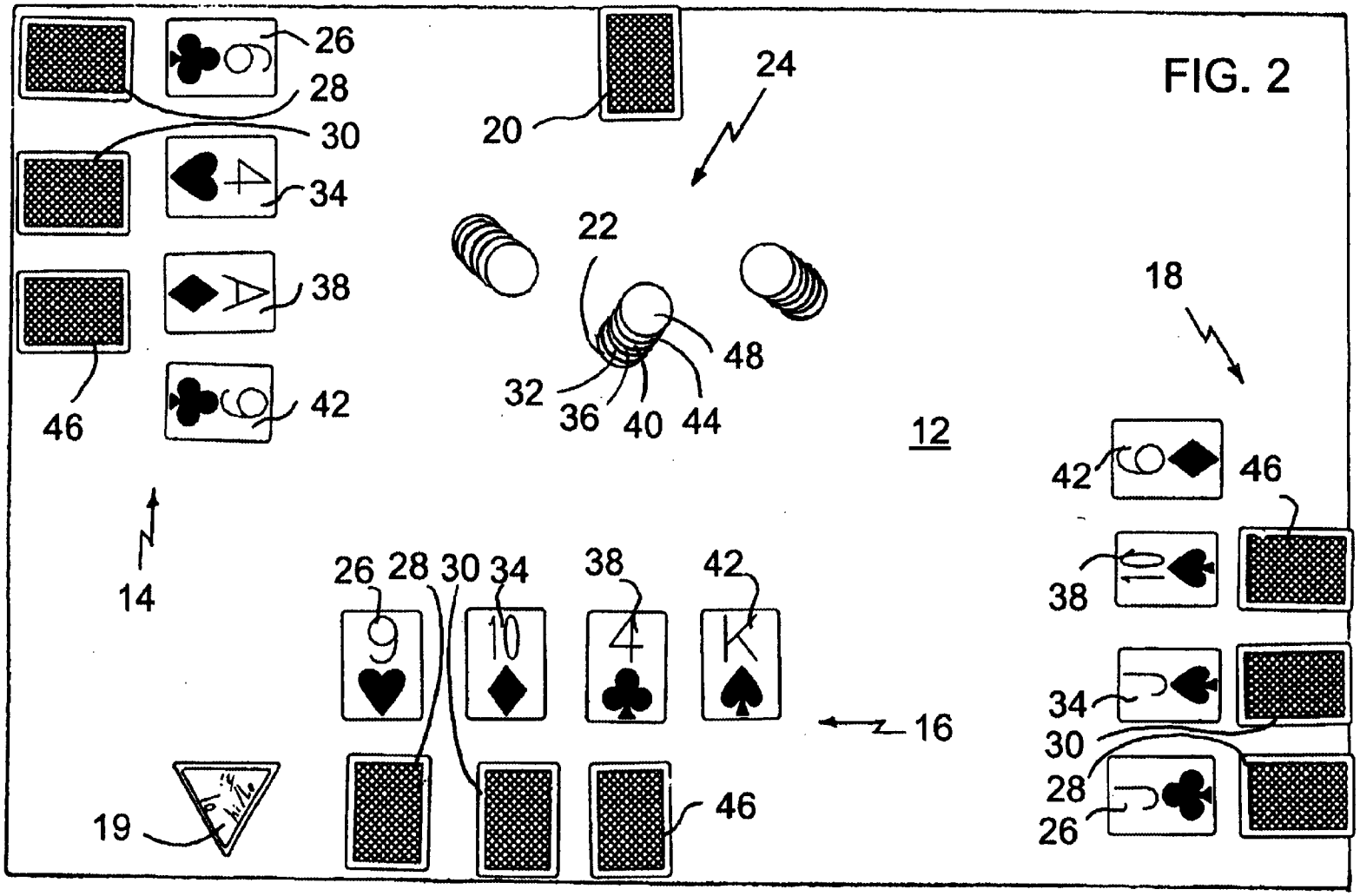
FIG. 2 is a top view of the venue and game shown in FIG. 1 at the sixth step: seventh card and fifth bet.
Figure 3:
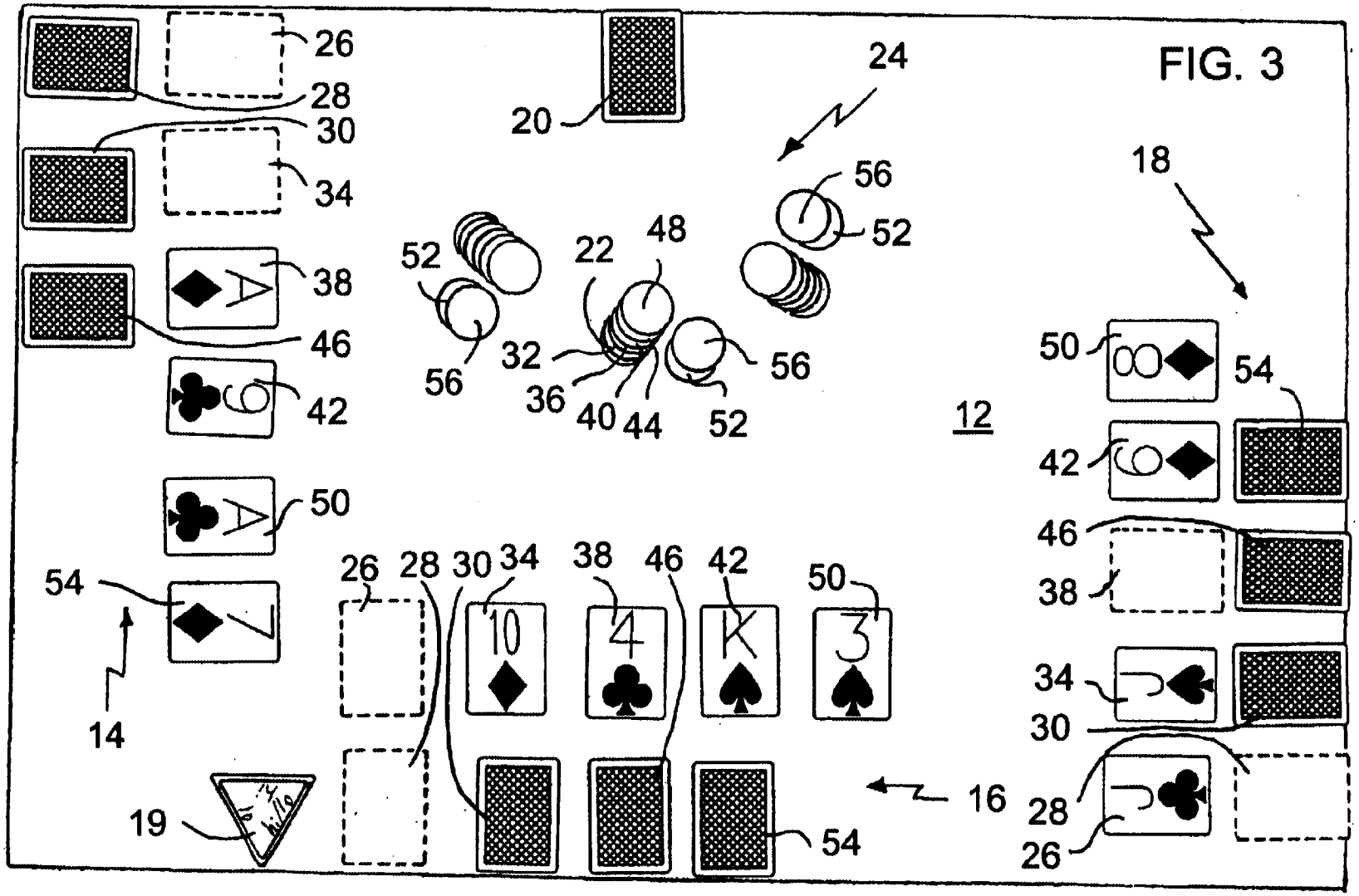
FIG. 3 is a top view of the venue and game shown in FIG. 2 at the tenth step: ninth card and seventh bet.
Figure 4:
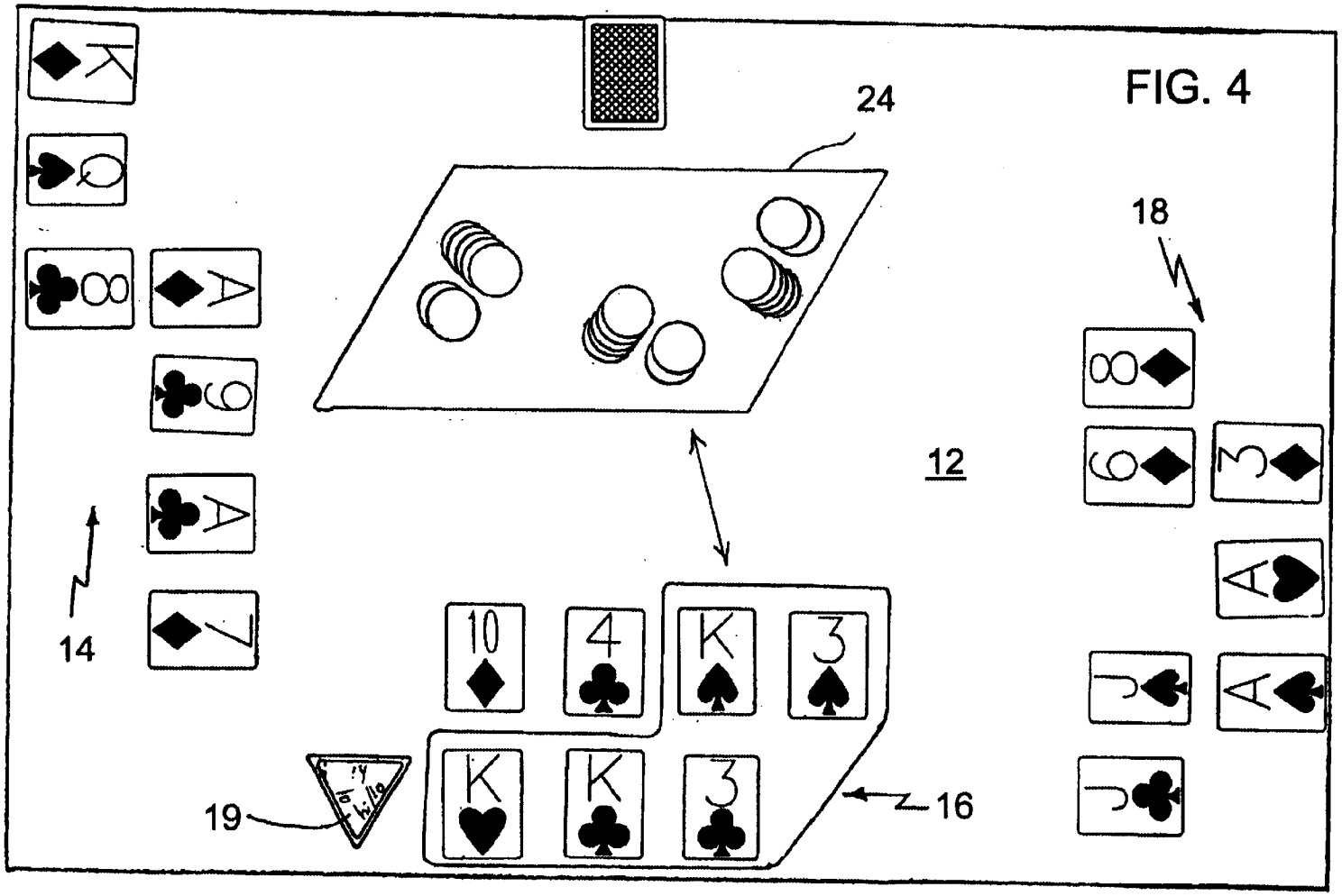
FIG. 4 is a top view of the venue and game shown in FIG. 3 upon the determination of a winner.

Referring to FIG. 1, a first step involves providing a venue 12 at which not less then three players and not more than six players compete for a jackpot against each other and not against the house. In the illustrated embodiment, a three-player game is illustrated for ease of illustration, showing the hands of each of first player 14, second player 16 and third player 18. It will be appreciated that in most situations the game will commence with a full compliment of six players. A three-sided chip 19 indicating hi, lo or hi/lo is provided. In the illustrated embodiment, second player 16 is the designated player who decides the "dealers choice", or, how the jackpot will be won. He indicates his choice of "hi" to the other players by the orientation of three-sided chip 19. Play is commenced with a 54 card deck 20 consisting of 52 regular playing cards and two wild cards. An ante 22 from each of first player 14, second player 16 and third player 18 is placed toward a jackpot 24 entitling each player to receive cards. A second step involves a dealer (not shown) dealing from deck 20 a first card 26 face up, a second card 28 face down and a third card 30 face down to each of first player 14, second player 16 and third player 18. Each individual player is allowed to view the faces of second card 28 and third card 30. Each player can elect to either fold, in which case their ante 22 is lost and the player is out of the game, or place a first bet 32 of a predetermined amount toward jackpot 24. In the illustrated embodiment, all three players, based upon the cards shown, have elected to place a first bet 32. Referring to FIG. 2, a third step involves dealing a fourth card 34 face up to each of first player 14, second player 16 and third player 18. Each player can elect to either fold, in which case first bet 32 and ante 22 are lost and the player is out of the game, or place a second bet 36 of a predetermined amount toward jackpot 24. A fourth step involves dealing a fifth card 38 face up to each of first player 14, second player 16 and third player 18. Each player can elect to either fold, in which case first bet 32, second bet 36 and ante 22 are lost and the player is out of the game, or place a third bet 40 of a predetermined amount toward jackpot 24. A fifth step involves dealing a sixth card 42 face up to each of first player 14, second player 16 and third player 18. Each player can elect to either fold, in which case first bet 32, second bet 36, third bet 40 and ante 22 are lost and the player is out of the game, or place a fourth bet 44 of a predetermined amount toward jackpot 24. A sixth step involves dealing a seventh card 46 face down to each of first player 14, second player 16 and third player 18 and allowing each individual player to view the face of seventh card 46. Each player can elect to either fold, in which case first bet 32, second bet 36, third bet 40, fourth bet 44 and ante 22 are lost and the player is out of the game, or place a fifth bet 48 of a predetermined amount toward jackpot 24. In the illustrated embodiment, all three players, based upon the cards shown, have elected to continue to receive cards and place a second bet 36, third bet 40, fourth bet 44 and a fifth bet 48. Referring to FIG. 3, a seventh step involves providing each player with an option of discarding one card in exchange for an eighth card 50. In the illustrated embodiment, first player 14, second player 16 and third player 18, have all decided to have an eighth card 50 dealt to them in exchange for one face-up card which is discarded. First player 14 discards his first card 26 and second player 16 discards his first card 26; whereas, third player 18 elects to discard his fifth card 38. Each player can elect to either fold, in which case first bet 32, second bet 36, third bet 40, fourth bet 44, fifth bet 48 and ante 22 are lost and the player is out of the game, or place a sixth bet 52 of a predetermined amount toward jackpot 24. An eighth step involves providing each player with an option of discarding one card in exchange for a ninth card 54. In the illustrated embodiment, first player 14, second player 16 and third player 18, have all decided to have a ninth card 54 dealt to them. However, in the illustrated embodiment, first player 14 has elected to discard another face up card, his fourth card 34; whereas, second player 16 and third player 18 have now elected to discard a face down card, their second card 28. Therefore, first layer 14 receives his ninth card 54 face up; whereas, second player 16 and third player 18 receive their ninth card 54 face down. Second player 16 and third player 18 are allowed to view the face of ninth card 54 dealt to them. Each player can elect to either fold, in which case first bet 32, second bet 36, third bet 40, fourth bet 44, fifth bet 48, sixth bet 52 and ante 22 are lost and the player is out of the game, or place a seventh bet 56 of a predetermined amount toward jackpot 24. In the illustrated embodiment, all three players, based upon the cards shown, have elected to continue to receive cards and place a sixth bet 52 and a seventh bet 56. Referring to FIG. 4, a final step involves determining a winner of jackpot 24 based upon one of a player with a highest hand, a player with a lowest hand, or a split between the player with the highest hand and the player with the lowest hand. In the illustrated embodiment, based upon the cards shown and given a criterion wherein the player with the best hand (in the illustrated embodiment: a 'full house') wins, second player 16 would be the winner of jackpot 24. Given the possibility of play with the variant hi/lo game as described above, in the illustrated embodiment, no player may declare "pig". Even though a player may have arrived at a "bicycle" straight flush, this was not a hi/lo game.

The poker variant described above is well suited for "rake" gambling games. There are seven betting rounds, which provides ample opportunity to either bet or fold to minimize ones losses. The rules are easy to understand, for after the first round you are betting as you receive or have an option to receive an additional card. Only a single deck of cards is used, so that the player is aware of what cards are available and can assess the relative strength or weakness of his or her cards. The two wild cards provide an additional dimension to the game. There are a maximum of six players, for, if all players remain in the game to the end, all 54 cards will be given out and the deck will be exhausted. Players can enhance their hands by exercising their option to trade for either an eighth card or a ninth card.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of playing a variation of seven card stud poker, comprising the steps of:

providing a venue at which not less then three players and not more than six players compete for a jackpot against each other and not against a house;

commencing play with a 54 card deck consisting of 52 regular playing cards and two wild cards;

placing an ante toward a jackpot before being entitled to receive any cards;

dealing a first card face up, a second card face down and a third card face down to each player and allowing each individual player to view the faces of the second card and the third card dealt to them;

electing to either fold, in which case the ante is lost and the player is out of the game, or place a first bet of a predetermined amount toward the jackpot;

dealing a fourth card face up to each remaining player;

electing to either fold, in which case the first bet and the ante are lost and the player is out of the game, or place a second bet of a predetermined amount toward the jackpot;

dealing a fifth card face up to each remaining player;

electing to either fold, in which case the first bet, the second bet and the ante are lost and the player is out of the game, or place a third bet of a predetermined amount toward the jackpot;

dealing a sixth card face up to each remaining player;

electing to either fold, in which case the first bet, the second bet, the third bet and the ante are lost and the player is out of the game, or place a fourth bet of a predetermined amount toward the jackpot;

dealing a seventh card face down to each remaining player and allowing each individual player to view the face of the seventh card dealt to them;

electing to either fold, in which case the first bet, the second bet, the third bet, the fourth bet and the ante are lost and the player is out of the game, or place a fifth bet of a predetermined amount toward the jackpot;

offering each remaining player an option of discarding one card in exchange for an eighth card, the eighth card being dealt either up or down depending upon whether the card it is replacing was up or down, should the eighth card be dealt down each individual player is allowed to view the face of the eighth card dealt to them;

electing to either fold, in which case the first bet, the second bet, the third bet, the fourth bet, the fifth bet and the ante are lost and the player is out of the game, or place a sixth bet of a predetermined amount toward the jackpot;

offering each remaining player an option of discarding one card in exchange for a ninth card, the ninth card being dealt either up or down depending upon whether the card it is replacing was up or down, should the eighth card be dealt down each individual player is allowed to view the face of the eighth card dealt to them;

electing to either fold, in which case the first bet, the second bet, the third bet, the fourth bet, the fifth bet, the sixth bet and the ante are lost and the player is out of the game, or place a seventh bet of a predetermined amount toward the jackpot; and determining a winner of the jackpot based upon one of a player with a highest hand, a player with a lowest hand, or a split between the player with the highest hand and the player with the lowest hand.

2. The method as defined in claim 1, wherein the winner of the jackpot is the player with the highest hand.

3. The method as defined in claim 1, wherein the winner of the jackpot is the player with the lowest hand.

4. The method as defined in claim 1, wherein the jackpot is split between the player with the highest hand and the player with the lowest hand.

* * * * *

UNITED STATES PATENT AND TRADEMARK OFFICE

CERTIFICATE OF CORRECTION

PATENT NO. : 6,755,421 B1
DATED : June 29, 2004
INVENTOR(S) : R.B. Aftergood

It is certified that error appears in the above-identified patent and that said Letters Patent is hereby corrected as shown below:

Title page,
Item [57], ABSTRACT,
Line 2, "then" should read -- than --

Column 5,
Line 13, "then" should read -- than --

Column 6,
Lines 23 and 24, "eighth" should read -- ninth --

Signed and Sealed this

Twenty-third Day of November, 2004

JON W. DUDAS
*Director of the United States Patent and Trademark Office*